US008348382B2

(12) United States Patent
Takahashi et al.

(10) Patent No.: US 8,348,382 B2
(45) Date of Patent: Jan. 8, 2013

(54) INKJET RECORDING APPARATUS

(75) Inventors: Sou Takahashi, Osaka (JP); Kikunosuke Tsuji, Osaka (JP)

(73) Assignee: Kyocera Mita Corporation (JP)

( * ) Notice: Subject to any disclaimer, the term of this patent is extended or adjusted under 35 U.S.C. 154(b) by 100 days.

(21) Appl. No.: 12/951,309

(22) Filed: Nov. 22, 2010

(65) Prior Publication Data

US 2011/0122192 A1 May 26, 2011

(30) Foreign Application Priority Data

Nov. 25, 2009 (JP) ..... 2009-267333

(51) Int. Cl.
*B41J 2/165* (2006.01)

(52) U.S. Cl. ..... 347/33; 347/22; 347/29; 347/32

(58) Field of Classification Search ..... 347/22, 347/29, 32, 33
See application file for complete search history.

(56) References Cited

U.S. PATENT DOCUMENTS

| | | | | |
|---|---|---|---|---|
| 7,252,361 | B2 * | 8/2007 | Nishikawa et al. | 347/22 |
| 2007/0139465 | A1 * | 6/2007 | Nakashima | 347/35 |
| 2008/0079773 | A1 | 4/2008 | Sakaida | |
| 2008/0170100 | A1 * | 7/2008 | Matsuhashi | 347/33 |
| 2008/0291241 | A1 * | 11/2008 | Kachi et al. | 347/33 |

FOREIGN PATENT DOCUMENTS

| | | |
|---|---|---|
| JP | 2008-80770 | 4/2008 |

* cited by examiner

*Primary Examiner* — Matthew Luu
*Assistant Examiner* — Alexander D Shenderov
(74) *Attorney, Agent, or Firm* — Gerald E. Hespos; Michael J. Porco

(57) ABSTRACT

In a cap mode where a cap member covers a nozzle surface, a controller controls a second movement mechanism so that the cap member is disposed opposite to the nozzle surface. In an ejection recovery mode where ink is ejected from a plurality of nozzles and the ink adhered to the nozzle surface is wiped off by a wiping member, the controller controls a first movement mechanism and the second movement mechanism so that the nozzle surface, a wiping tray and the cap member are arranged downward in this order.

16 Claims, 14 Drawing Sheets

22
22a
118
82
122
83
123
124
D1

C
222(22)
221
(22)
22
118
22a
82
122
83
123
124
H
D1

22
22a
118
82
122
83
123
124
N1
H
D1

INKJET RECORDING APPARATUS

BACKGROUND OF THE INVENTION

1. Field of the Invention

The present invention relates to an inkjet recording apparatus.

2. Description of the Related Art

As a conventional inkjet recording apparatus, there is known a line printer that has an inkjet head with a nozzle surface provided linearly with a plurality of nozzles. On the nozzle surface of the inkjet head, the plurality of nozzles are arrayed linearly in a direction perpendicular to a sheet conveying direction (sheet width direction).

In such an inkjet recording apparatus, the nozzle surface is sealed with a cap in order to prevent the ink from becoming increasingly viscous when unused. However, when the inkjet recording apparatus is not used for a long time, the ink becomes increasingly viscous and the viscous ink might clog the flow passages of the inkjet recording apparatus, as well as the nozzles. Thus, when the inkjet recording apparatus is used, an ejection recovery processing is executed to forcibly discharge the viscous ink. After the ink is ejected from the plurality of nozzles by this ejection recovery processing, the ink adhered to the nozzle surface is removed by a wiper blade.

As a conventional inkjet recording apparatus, there is known an apparatus that is provided with a maintenance unit having such a cap and wiper blade as described above. In this apparatus, ink is ejected from a plurality of nozzles by the ejection recovery processing, and thereafter, the edge of the wiper blade is brought into contact with a nozzle surface. A waste tray is then moved in a direction substantially parallel to the nozzle surface, whereby the ink adhered to the nozzle surface is wiped off by the wiper blade. The wiped ink moves downward along the wiper blade and is then stored in the waste tray.

However, the ink adhered to the nozzle surface in this ejection recovery processing is not only the ink that is wiped off by the wiper blade as described above and is then stored in the waste tray along the wiper blade, but also ink droplets that fall from the nozzle surface. In some cases, the wiper blade might not be able to wipe off the ink appropriately, and the ink droplets might fall from the nozzle surface after the wiper blade passes therethrough. The ink droplets falling downward from the nozzle surface can contaminate the inside of the apparatus.

SUMMARY OF THE INVENTION

An object of the present invention is to provide an inkjet recording apparatus, which is capable of preventing contamination of the inside thereof that is caused due to falling of ink adhered to a nozzle surface in the ejection recovery processing.

An inkjet recording apparatus of the present invention includes: an inkjet head that has a nozzle surface including a nozzle forming region provided with a plurality of nozzles; a tray that is capable of being disposed opposite to the nozzle surface and storing ink ejected from the plurality of nozzles; a wiping member that is supported by the tray and capable of coming into contact with the nozzle surface; a first movement mechanism that moves the tray relatively with respect to the inkjet head in a direction substantially parallel to the nozzle surface; a cap member that is capable of being disposed opposite to the nozzle surface to cover the nozzle surface; a second movement mechanism that moves the cap member relatively with respect to the inkjet head in the direction substantially parallel to the nozzle surface; and a controller that controls the first movement mechanism and the second movement mechanism.

In a cap mode where the cap member covers the nozzle surface, the controller controls the second movement mechanism so that the cap member is disposed opposite to the nozzle surface. Then, in an ejection recovery mode where the ink is ejected from the plurality of nozzles and the ink adhered to the nozzle surface is wiped off by the wiping member, the controller controls the first movement mechanism and the second movement mechanism so that the nozzle surface, the tray and the cap member are arranged, in this order, in an ejection direction in which the ink is ejected from the nozzles.

DETAIL DESCRIPTION OF THE PREFERRED EMBODIMENTS

The inkjet recording apparatus according to an embodiment of the present invention is described hereinafter in detail with reference to the drawings.

<The Entire Structure of the Inkjet Recording Apparatus>

Figure 1:
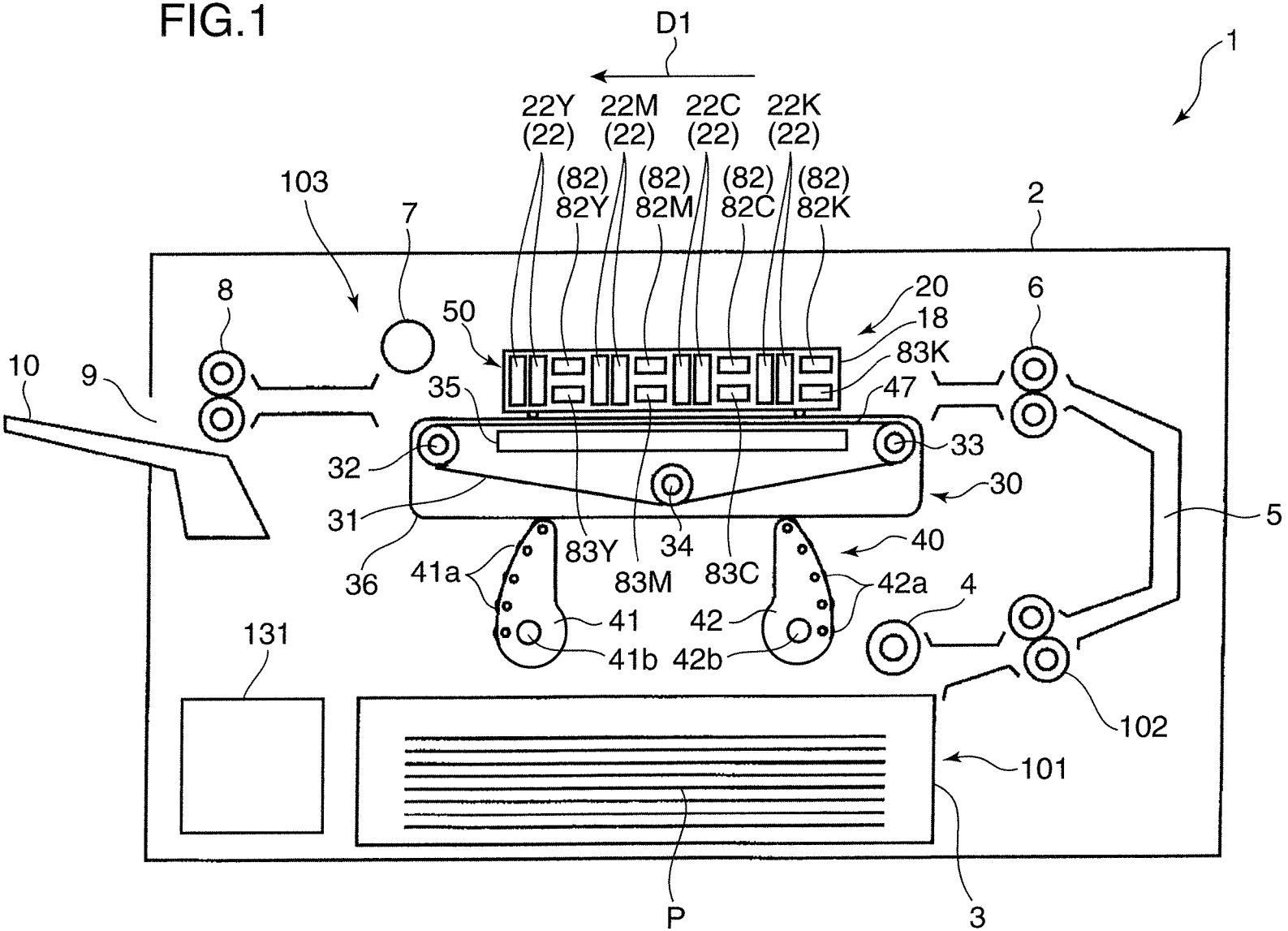
FIG. 1 is a configuration diagram schematically showing an inkjet recording apparatus according to an embodiment of the present invention.

An inkjet recording apparatus 1 shown in FIG. 1 is an inkjet printer that is capable of forming an image on a recording medium, e.g., a sheet P, on the basis of image information received from an external computer. This recording apparatus 1 has, within a casing 2 thereof, a recording part 20, sheet storing part 101, sheet conveying path 5, conveyance unit 30, lifting mechanism 40, delivery part 103, maintenance unit 50, and controller 131 controlling these elements. It should be noted in the following description that a conveying direction in which the sheet P is conveyed on the conveyance unit 30 is referred to as "direction D1" and a direction perpendicular thereto (a width direction of the sheet P) as "direction D2."

Figure 2:
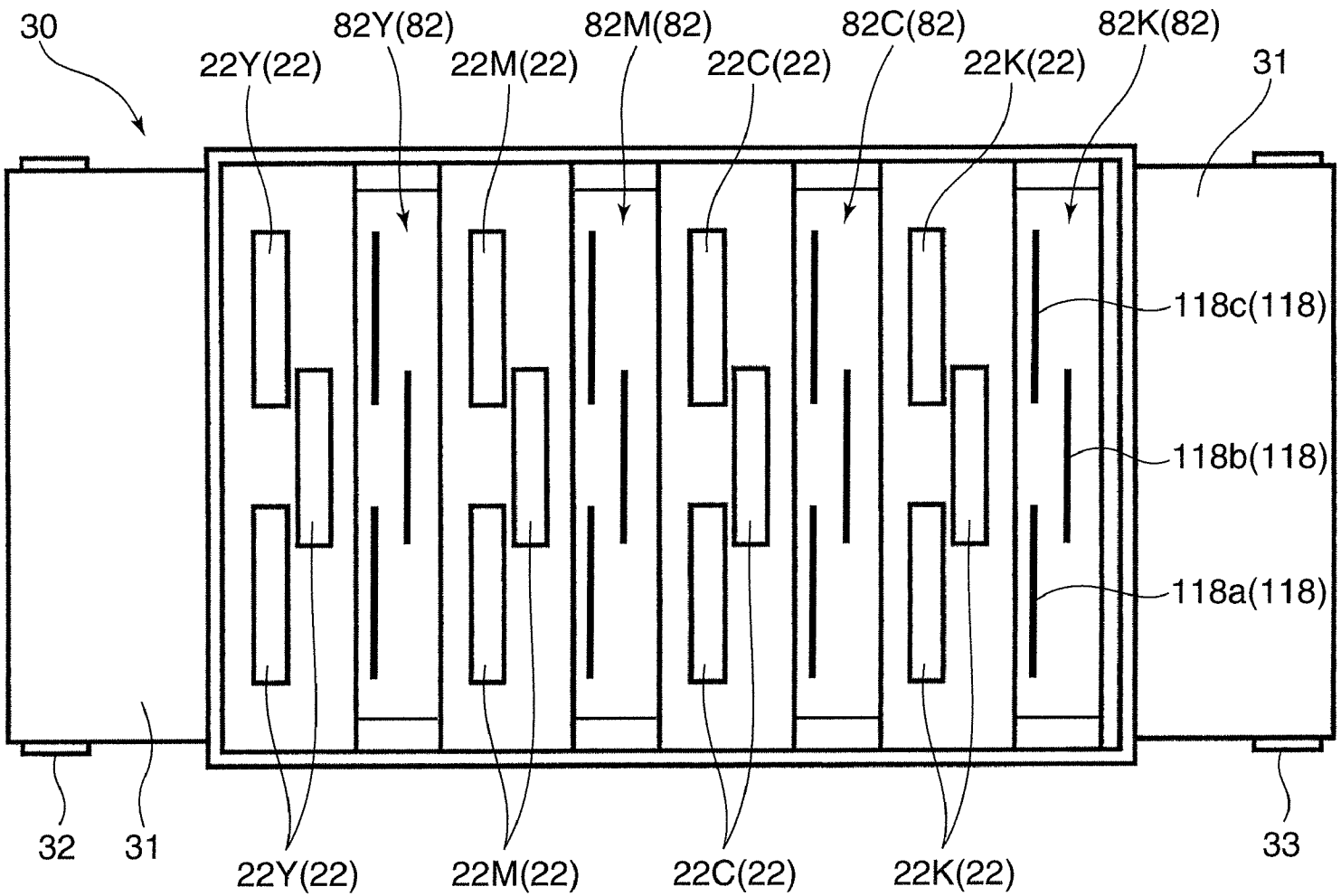
FIG. 2 is a plan view schematically showing the positional relationship among inkjet heads, a maintenance unit and a conveyance unit of the inkjet recording apparatus.

The recording part 20 has four groups of (twelve) inkjet heads 22 (22K, 22C, 22M and 22Y) corresponding to colors black, cyan, magenta and yellow, sequentially, from an upstream side of the direction D1, as shown in FIG. 2. The inkjet recording apparatus 1 is provided with four ink tanks, not shown, that correspond to the inkjet heads 22 of these colors. The ink of these colors are replenished from the relevant ink tanks to the corresponding inkjet heads 22. It should be noted in the following description that the identification symbols "K," "C," "M" and "Y" are omitted unless otherwise specified.

The twelve inkjet heads 22 are arranged above a conveying belt 31 of the conveyance unit 30, which will be described hereinafter. Each of the inkjet heads 22 is supported by a head supporting member (not shown). Each of the inkjet heads 22 has a nozzle surface 22*a* on its lower surface (FIG. 8B). The nozzle surface 22*a* is provided with a plurality of nozzles for ejecting the ink. The nozzle surface 22*a* is in a rectangular form along a direction perpendicular to the conveying direction of the sheet P. Each of the inkjet heads 22 is a line-type head that is capable of forming an image by ejecting the ink from the nozzle surface 22*a* in a direction substantially perpendicular to a sheet surface of the sheet P.

As an ink ejection system of the inkjet heads 22, various types of systems can be adopted, such as a piezo system that extrudes the ink using piezo elements, and a thermal inkjet system that generates air bubbles using a heat generator and then applies pressure to eject the ink.

The sheet storing part 101 capable of storing the sheet P is disposed below the recording part 20. The sheet storing part 101 has a sheet feeding cassette 3 storing sheets, and a sheet feeding roller 4 for feeding sheets to the sheet conveying path 5.

The sheet conveying path 5 has rollers 102 that configure a section on the upstream side of the sheet conveying path 5, and resist rollers 6 that stop each of the sheets for a while, to correct the inclination thereof, and then sends the sheet to the conveyance unit 30.

The conveyance unit 30 is disposed below the recording part 20. This conveyance unit 30 feeds the sheet P to the recording part 20, and conveys, to the delivery part 103, the sheet P on which the image is formed by the recording part 20. The conveyance unit 30 has a frame 36, rollers 32, 33 and 34, the conveying belt 31, and a sheet retention mechanism 35.

The rollers 32, 33 and 34 are spaced apart from one another by a predetermined distance and supported by the frame 36 so as to rotate freely in the direction D1.

The conveying belt 31 is an endless belt wrapped around the rollers 32, 33 and 34. An upper surface of the conveying belt 31 between the roller 33 and the roller 32 functions as a conveying surface 47 for conveying the sheet P. This conveying surface 47 faces the nozzle surfaces 22*a* of the plurality of the inkjet heads 22.

The sheet retention mechanism 35 is provided below and along the conveying surface 47 of the conveying belt 31 and disposed so as to face the recording part 20. An upper surface of a case of this sheet retention mechanism 35 has a plurality of air vacuum holes (not shown) for introducing external air into the case. A plurality of air vacuum holes (not shown) are provided in the conveying belt 31 as well. Therefore, the air is introduced by the sheet retention mechanism 35, and consequently the sheet P is absorbed onto the upper surface of the conveying belt 31. In this manner, the sheet P can be conveyed stably.

The lifting mechanism 40 has a pair of eccentric cams 41, 42 that is disposed below the conveyance unit 30. Axes 41*b*, 42*b* of the eccentric cams 41, 42 are supported by, respectively, supporting members, which are not shown, and the eccentric cams 41, 42 are caused to turn around the axes 41*b*, 42*b* by a drive motor, which also is not shown. The eccentric cams 41, 42 have a plurality of bearings 41*a*, 42*a*. These bearings 41*a*, 42*a* support the conveyance unit 30 while abutting with the frame 36 of the conveyance unit 30. The conveyance unit 30 moves up and down as the eccentric cams 41, 42 turn around the respective axes 41*b*, 42*b*.

FIG. 1 illustrates a condition in which the eccentric cams 41, 42 stand up substantially straight in a vertical direction to lift up the conveyance unit 30. From this condition, the conveyance unit 30 is dropped, as shown in FIG. 3, when the eccentric cams 41, 42 rotate inward to face each other.

In an image formation mode where the recording part 20 forms the image on the sheet P, the conveyance unit 30 is lifted up by the lifting mechanism 40 and disposed in a position proximal to the nozzle surfaces 22*a* of the inkjet heads 22, as shown in FIG. 1. This proximity position is adjusted so that the nozzle surfaces 22*a* and the sheet P keep a distance appropriate for printing.

Figure 3:
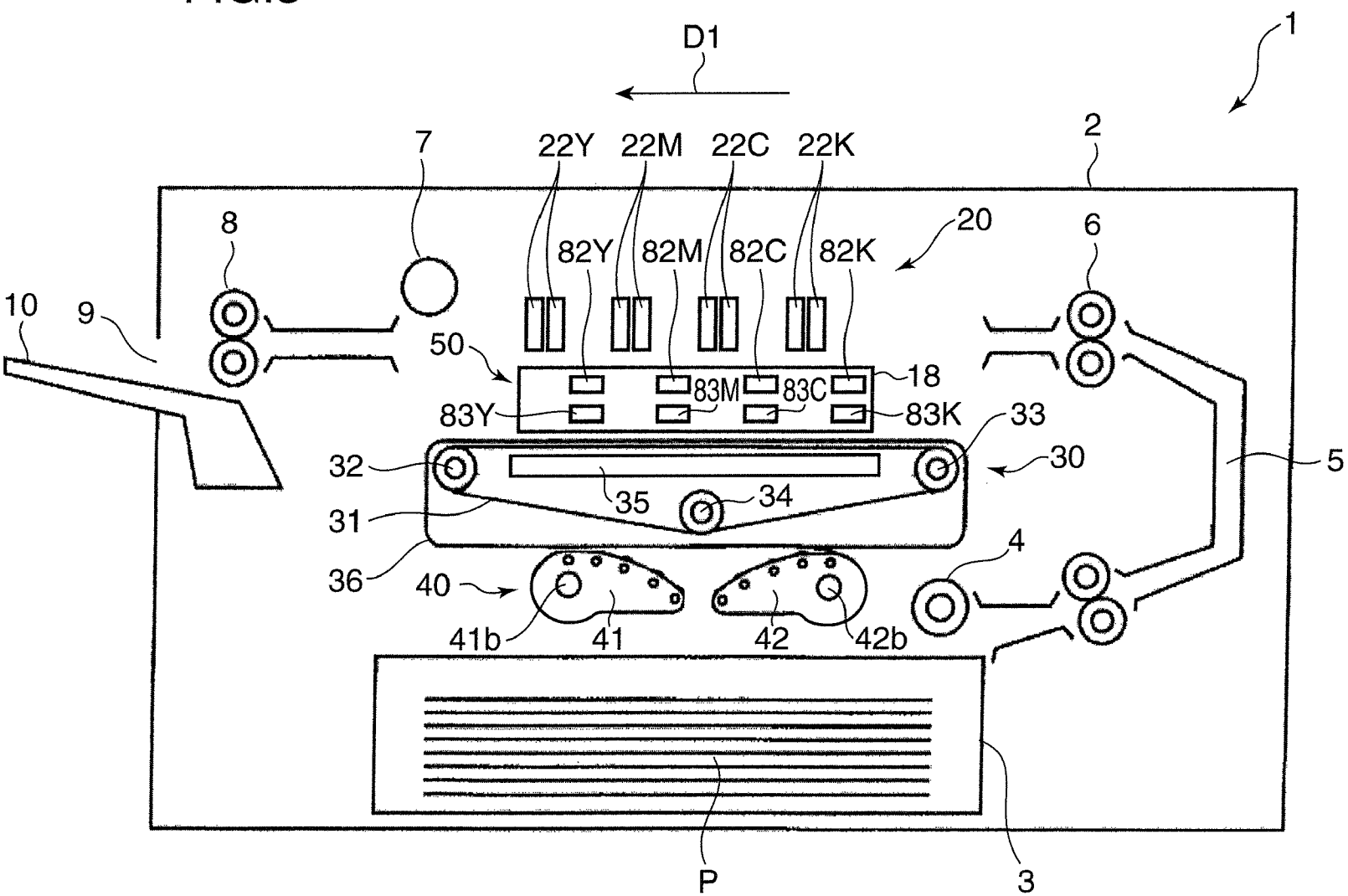
FIG. 3 is a configuration diagram schematically showing a condition in which the conveyance unit and maintenance unit are dropped by a lifting mechanism of the inkjet recording apparatus.

In an ejection recovery mode or cap mode, on the other hand, the conveyance unit 30 is dropped by the lifting mechanism 40 and moved away from the inkjet heads 22, as shown in FIG. 3. Note that the height of the conveyance unit 30 can be adjusted appropriately by adjusting the rotation angle of the eccentric cams 41, 42.

The delivery part 103 has a drying device 7, delivery rollers 8, a delivery port 9 and delivery tray 10. The drying device 7 is disposed on the downstream side of the direction D1 from the conveyance unit 30. The ink that is ejected to the sheet P in the recording part 20 is dried by the drying device 7. The sheet P with the dried ink thereon is sent to the delivery port 9 by the delivery rollers 8, and then delivered to the delivery tray 10 that extends to the outside from a side surface of the casing 2.

The controller 131 is constituted by a central processing unit (CPU), a memory (ROM) in which programs and other data are stored, and a memory (RAM) for temporarily storing the data upon execution of the programs. This controller 131 controls the operations of the lifting mechanism 40, a first movement mechanism and second movement mechanism, which are described hereinafter.

<Maintenance Unit>

The maintenance unit 50 is described next.

As shown in FIGS. 4 to 7, the maintenance unit 50 has a frame body 81, four wiping units 82 (82K, 82C, 82M, 82Y) supported by the frame body 81, four cap units 83 (83K, 83C, 83M, 83Y) supported by the frame body 81, guide rails 111 to 114, motors M1, M2, and shafts S1, S2.

The guide rails 111, 113, motor M1, and shaft S1 function as the first movement mechanism for moving the wiping units 82 with respect to the inkjet heads 22. The guide rails 112, 114, motor M2, and shaft S2 function as the second movement mechanism for moving the cap units 83 with respect to the inkjet heads 22.

Figure 7:
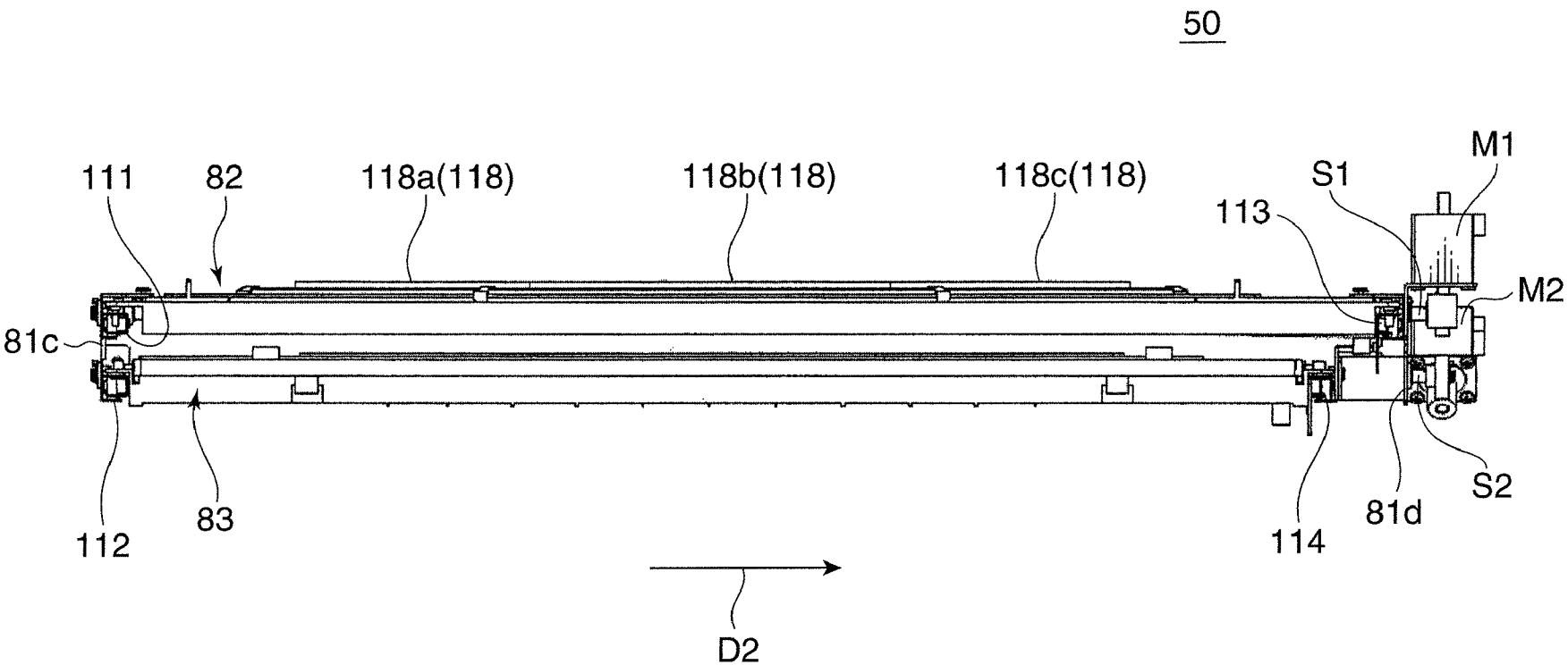
FIG. 7 is a side view in which the maintenance unit is viewed from an upstream side of a sheet conveying direction.

In a planar view, each of the wiping units 82 and each of the cap units 83 are in a rectangular form with a short side in the direction D1 and a long side in the direction D2 perpendicular to the direction D1. When viewed from the upstream side of the direction D1 as shown in FIG. 7, each of the wiping units 82 and each of the cap units 83 are in a thin, flat shape elongated in the direction D2. The wiping units 82 and cap units 83 are described hereinafter in detail.

Figure 4:
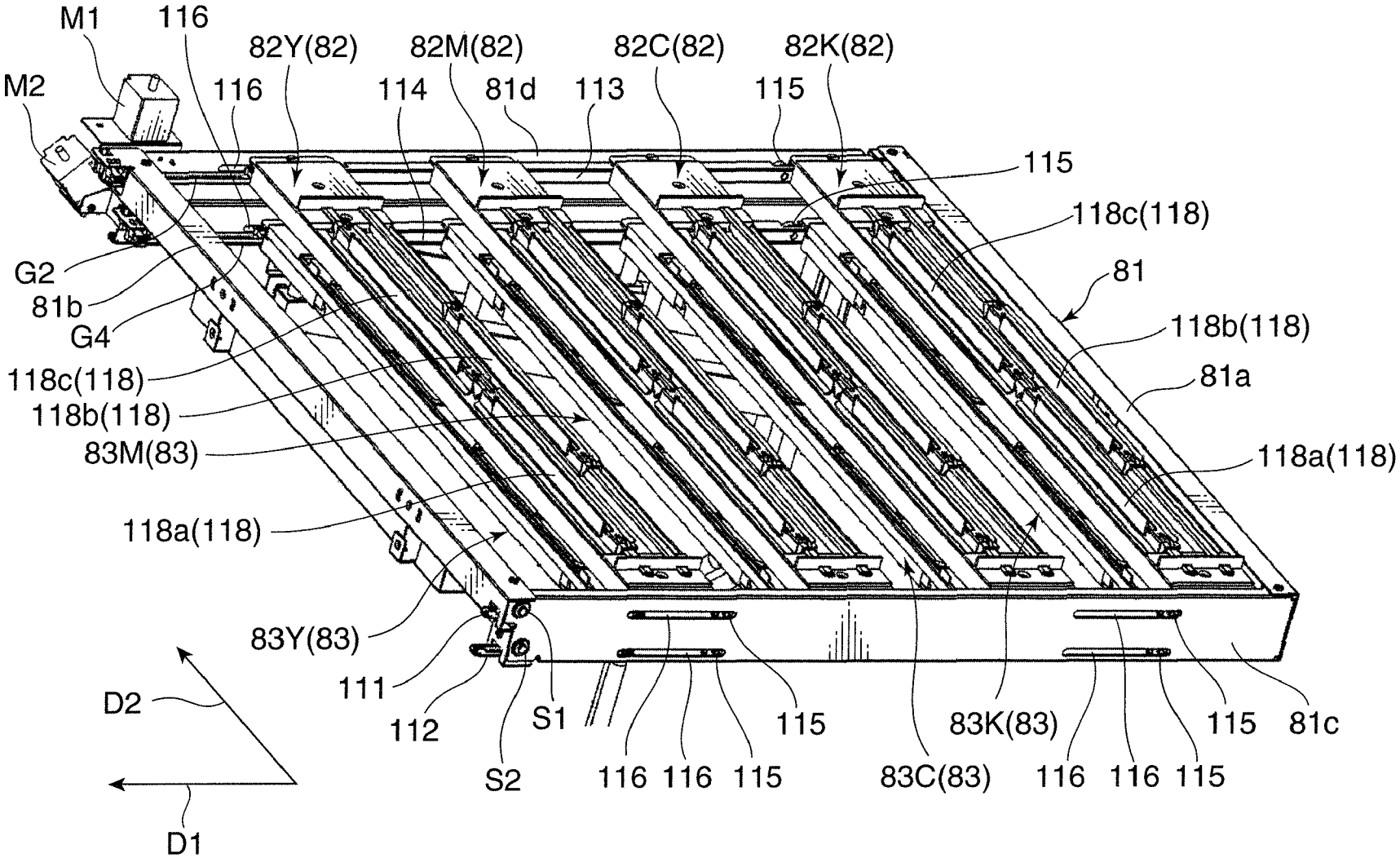
FIG. 4 is a perspective diagram showing the maintenance unit.

As shown in FIG. 4, the frame body 81 is configured by combining four long frame members 81*a* to 81*d* into a rectangular form in a planar view. The wiping units 82 and cap units 83 are disposed in a space surrounded by these frame members 81*a* to 81*d*. In this space within the frame body 81, the wiping units 82 are disposed above the corresponding cap units 83.

Figure 5:
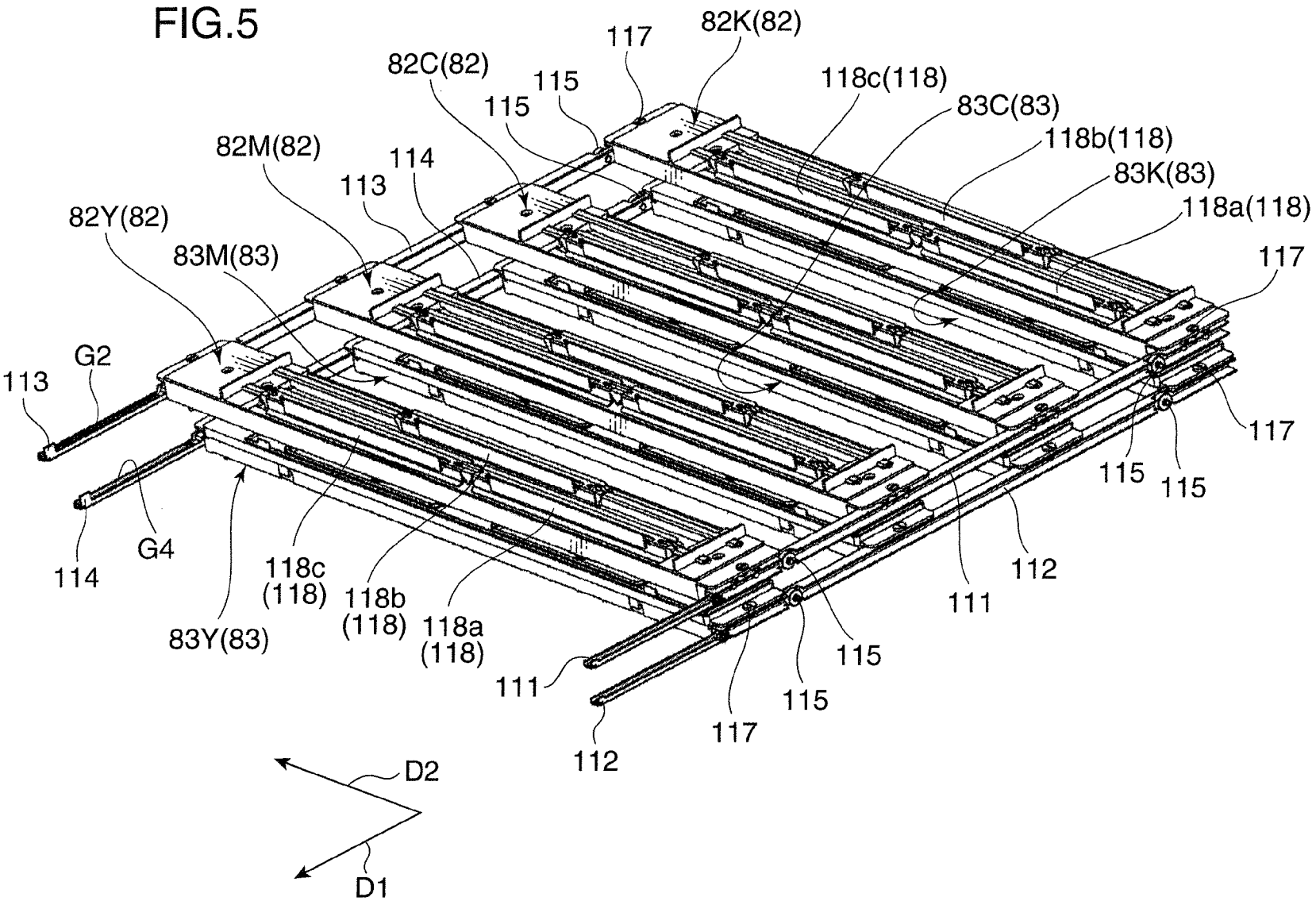
FIG. 5 is a perspective diagram showing a condition in which a frame body of the maintenance unit shown in FIG. 4 is dismounted.
Figure 6:
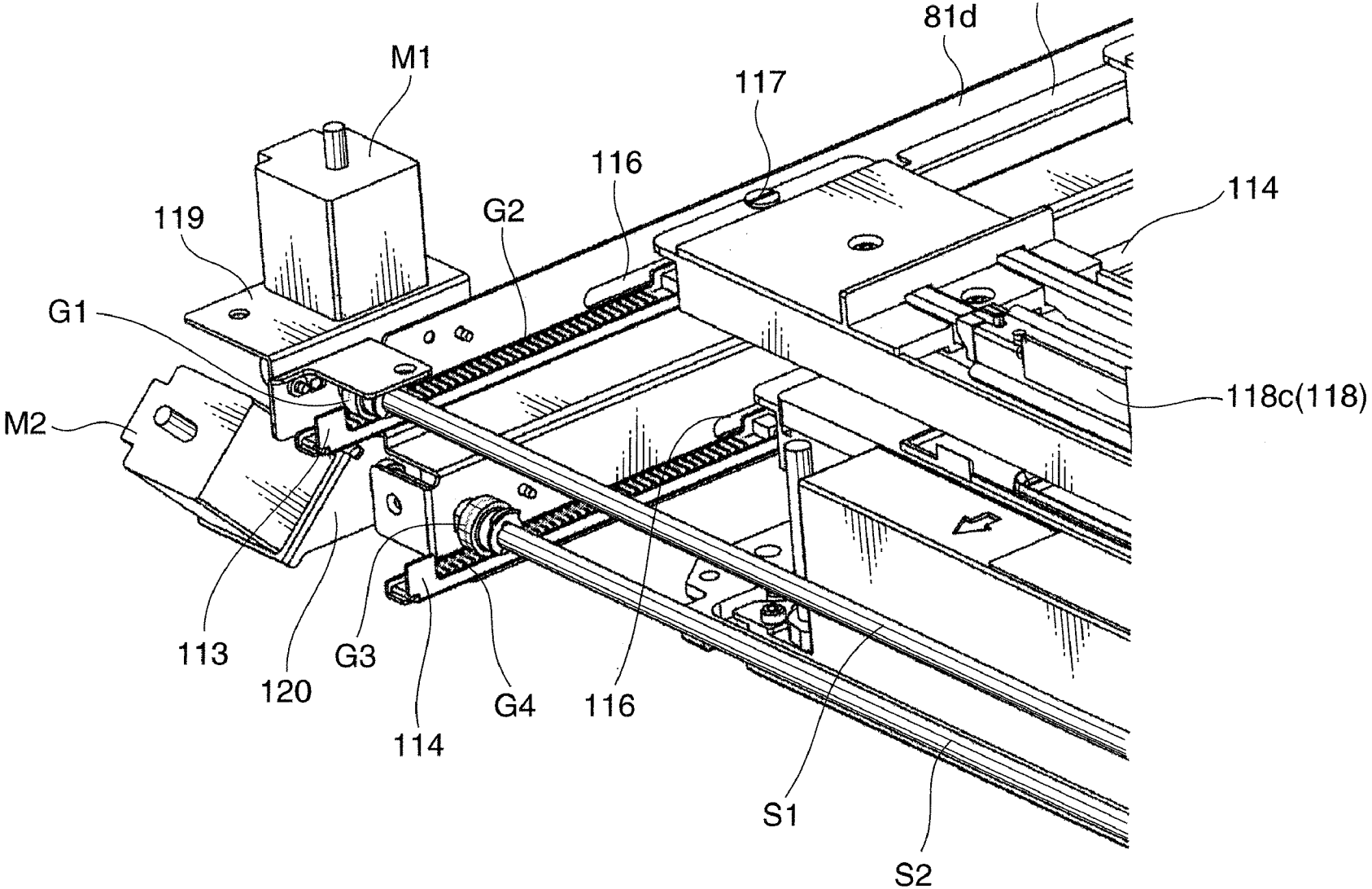
FIG. 6 is a perspective diagram showing an enlargement of a part of the maintenance unit.

Of the four frame members 81*a* to 81*d*, the frame member 81*c*, which is disposed on one side of the direction D2 and extends in the direction D1, has four long holes 116 extending in the direction D1, as shown in FIGS. 4 to 6. Two of these four long holes 116 are provided in an upper part of the frame member 81*c*. The remaining two long holes 116 are provided below those two long holes 116. The upper two long holes 116 are formed along the guide rail 111 (along the positions of the wiping units 82). The lower two long holes 116 are formed along the guide rail 112 (along the positions of the cap units 83).

Furthermore, the frame body 81*d*, which is disposed on the other side of the direction D2 and extends in the direction D1, has four long holes 116 that are in the same shape as the four long holes 116 of the frame member 81*c* and disposed opposite thereto.

The guide rails 111 and 112 are disposed inside the frame member 81*c* in substantially parallel with the frame member 81*c*. The guide rail 112 is disposed below the guide rail 111. The guide rails 113 and 114, on the other hand, are disposed inside the frame member 81*d* in substantially parallel with the frame body 81*d*. The guide rail 114 is disposed below the guide rail 113.

As shown in FIG. 5, the guide rail 111 and guide rail 113 support end parts of the wiping units 82. Each of the end parts of the wiping units 82 is fixed to the guide rails 111, 113 by a screw 117. The distance between adjacent wiping units 82 is adjusted to the size that allows the inkjet heads 22 to be disposed therebetween.

Similarly, the guide rail 112 and guide rail 114 support end parts of the cap units 83. Each of the end parts of the cap units 83 is fixed to the guide rails 112, 114 by the screw 117. The distance between adjacent cap units 83 is adjusted to the size that allows the inkjet heads 22 to be disposed therebetween.

The guide rail 111 has two projecting parts 115 that project to the frame member 81*c* side. One of the projecting parts 115 is provided in a position on the upstream side of the direction D1 (the position between the wiping unit 82K and the wiping unit 82C), and the other projecting part 115 is provided in a position on the downstream side of the direction D1 (the position between the wiping unit 82M and the wiping unit 82Y). Similarly, the guide rail 112 has two projecting parts 115 that project to the frame member 81*c* side. One of the projecting parts 115 is provided in the position between the cap unit 83K and the cap unit 83C, and the other projecting part 115 is provided in the position between the cap unit 83M and the cap unit 83Y. The guide rails 113, 114 also have similar projecting parts 115 in the positions opposite to the direction D2 with respect to the projecting parts 115 of the guide rails 111, 112.

The two projecting parts 115 of the guide rail 111 are engaged with the upper two long holes 116 of the frame member 81*c*. The two projecting parts 115 of the guide rail 113 are engaged with the upper two long holes 116 of the frame member 81*d*. These projecting parts 115 are capable of moving along the direction D1, within a longitudinal opening range of each long hole 116.

Similarly, the two projecting parts 115 of the guide rail 112 are engaged with the lower two long holes 116 of the frame member 81*c*. The two projecting parts 115 of the guide rail 114 are engaged with the lower two long holes 116 of the frame member 81*d*. These projecting parts 115 are capable of moving along the direction D1, within a longitudinal opening range of each long hole 116.

In this way, the guide rails 111 to 114 are supported by the engagement between the projecting parts 115 and the long holes 116 so as to be able to slide and move along the direction D1 with respect to the frame body 81. Therefore, the four wiping units 82 slide and move in the direction D1 in response to the sliding movement of the guide rail 111 and guide rail 113. The four cap units 83 slide and move in the direction D1 in response to the sliding movement of the guide rail 112 and guide rail 114.

As shown in FIGS. 4 and 6, the shaft S1 is supported rotatably by an end part of the frame member 81*c* in the direction D1 and an end part of the frame member 81*d* in the direction D1. The shaft S2 is disposed below the shaft S1 and supported rotatably by the end part of the frame member 81*c* in the direction D1 and the end part of the frame member 81*d* in the direction D1.

The shaft S1 has a toothed drive gear G1 at an end part thereof on the frame member 81*d* side. This drive gear G1 is meshed with a linear rack gear G2 that is provided at an end part of the guide rail 113 in the direction D1. The shaft S2 has a toothed drive gear G3 at an end part thereof on the frame member 81*d* side. This drive gear G3 is meshed with a linear rack gear G4 that is provided at an end part of the guide rail 114 in the direction D1.

Note that, although not shown, the shaft S1 has a gear G1 at an end part thereof on the frame member 81*c* side as well. This gear G1 is meshed with a gear G2 that is provided at an end part of the guide rail 111 in the direction D1. Similarly, although not shown, the shaft S2 has a gear G3 at an end part thereof on the frame member 81*c* side as well. This gear G3 is meshed with a gear G4 that is provided at an end part of the guide rail 112 in the direction D1.

As shown in FIG. 6, the motor M1 is fixed to an external surface of the end part of the frame member 81*d* in the direction D1, by a supporting member 119. The motor M2, disposed below the motor M1, is fixed to an external surface of the end part of the frame member 81*d* in the direction D1, by a supporting member 120. A rotation axis of the motor M1, not shown, is fixed to the end part of the shaft S1. A rotation axis of the motor M2, also not shown, is fixed to the end part of the shaft S2.

When the motor M1 is driven, the shaft S1 rotates along with the gears G1. As a result, the guide rails 111 and 113 with the gears G2 move along with the wiping units 82 in the direction D1 or in a direction opposite thereto. The direction of movement can be changed by inverting the direction of rotation of the motor M1. Similarly, when the motor M2 rotates, the guide rails 112 and 114 move along with the cap units 83 in the direction D1 or in a direction opposite thereto.

Figure 8A:
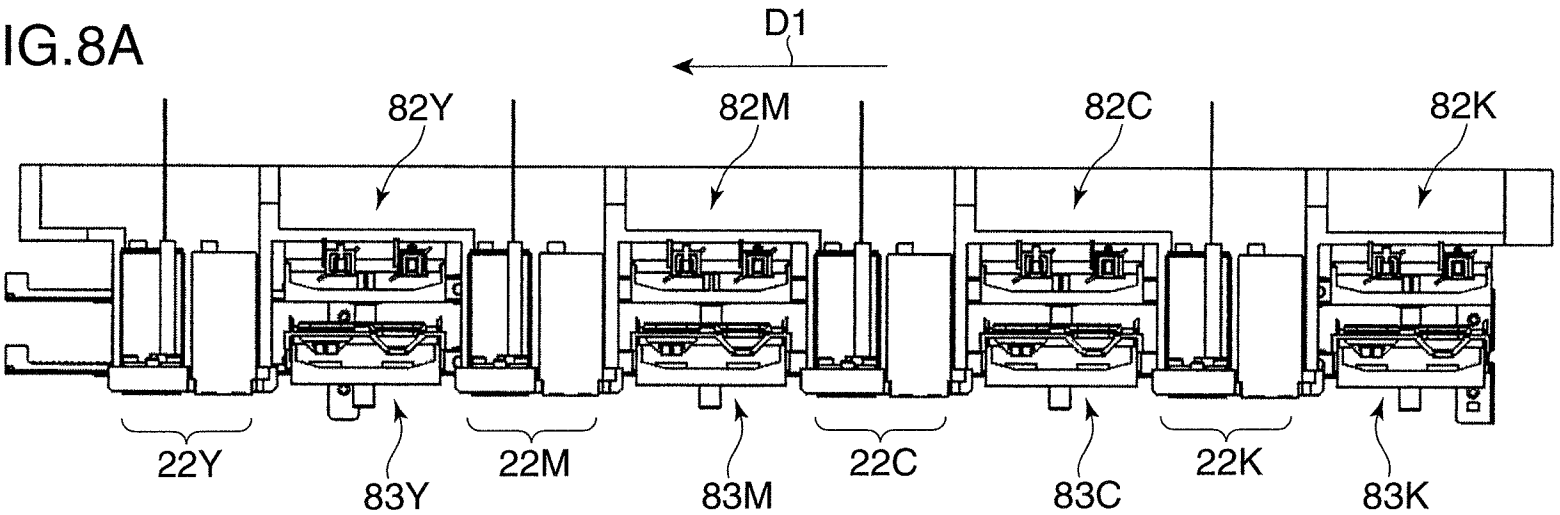
FIG. 8A is a diagram showing the positional relationship among the inkjet heads, wiping units and cap units in an image formation mode.
Figure 8B:
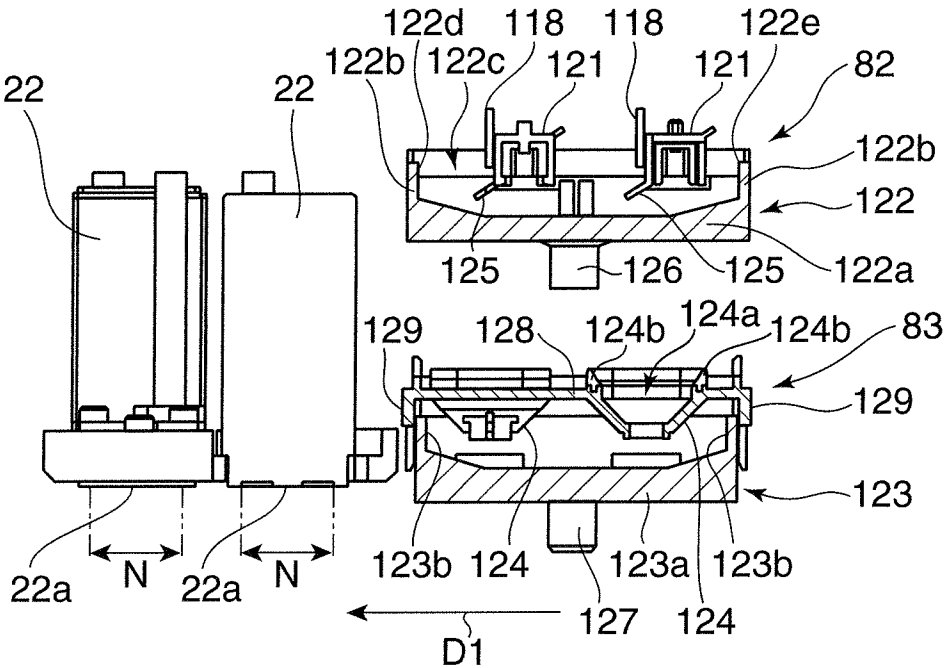
FIG. 8B is a diagram showing an enlargement of a part of the positional relationship shown in FIG. 8A.

FIG. 8A shows the positional relationship among the inkjet heads 22, wiping units 82 and cap units 83 in the image formation mode. In the image formation mode, each wiping unit 82 and each cap unit 83 retreat to a position next to (immediately lateral to) each inkjet head 22, i.e., a retreat position in the direction opposite to the direction D1.

As shown in FIG. 8B, each wiping unit 82 has a wiping tray 122, wiping members 118, supporting members 121, and ink guide pieces 125.

The wiping tray 122 has a rectangular bottom plate 122*a*, side walls 122*b* that extend upward from a circumferential rim of the bottom plate 122*a*, and an opening part 122*c* at an upper part of the wiping tray 122. The opening part 122*c* has an opening region, which encompasses, within its range, nozzle forming regions N of the nozzle surfaces 22*a* while the wiping unit 82 performs a wiping operation in the ejection recovery mode that is described hereinafter. Here, the nozzle forming regions N each mean a region where the plurality of nozzles are formed (arrayed) in each nozzle surface 22*a* (see FIG. 12). In other words, each of the nozzle forming regions N is a region that is enclosed with line drawn along the plurality of nozzles located outside (on the circumference) of the plurality of nozzles arrayed in the nozzle surface 22*a*.

Each wiping unit 82 has three wiping members 118 that are supported on the wiping tray 122 by the supporting member 121. The three wiping members 118 are located so as to correspond to each group of three inkjet heads 22. As shown in FIGS. 4 and 8B, each of the wiping members 118 is in a flat shape elongated in the direction D2. The lower half of each of the wiping members 118 is in contact with the supporting member 121, whereas the upper half projects from the supporting member 121 in the height direction. The wiping members 118 have elasticity.

Two of the three wiping members 118 are disposed in the direction D1 side, and the remaining one is disposed toward the opposite side of the direction D1 from these wiping members 118. The two in the direction D1 are disposed on both sides in a longitudinal direction of the wiping unit 82 with a predetermined distance therebetween. The remaining one is disposed in substantially in the middle of the two wiping members 118.

The ink wiped off by each wiping member 118 moves downward along the wiping member 118 and is then stored in the wiping tray 122 via the ink guide pieces 125. The stored ink is vacuumed by, for example, a pump and collected by an ink collection port 126.

As shown in FIG. 8B, each of the cap units 83 has a cap tray 123 and cap members 124. Each cap unit 83 has three cap members 124. The three cap members 124 of the cap unit 83 close the nozzle surfaces 22*a* of the corresponding three inkjet heads 22.

Each cap tray 123 has a bottom plate 123*a* that is in substantially the same size as the bottom plate 122*a* of the wiping tray 122, and side walls 123*b* that extend upward from a circumferential rim of the bottom plate 123*a*. Each cap tray 123 supports the cap members 124. Each cap tray 123 is larger than each cap member 124 in terms of size in the directions along the nozzle surfaces 22*a* (the direction D1 and the direction D2).

Each cap member 124 is formed to fit into the shape of a lower end part of the corresponding inkjet head 22. In other words, each cap member 124 has an opening part 124*a* that is large enough to be able to cover the nozzle forming region N of the corresponding inkjet head 22. Each cap member 124 has an elastic member 124*b* that is provided along a circumferential rim of the opening 124*a*.

Furthermore, the three cap members 124 configure a lid part with a panel part 128 that connects these cap members 124 and an extending part 129 that extends downward from a circumferential rim of the panel part 128. This lid part closes an opening formed in an upper part of the cap tray 123.

<Image Formation Mode>

The operations of the recording apparatus 1 in the image formation mode are described next.

First, when a command for forming an image is issued by a computer connected to the outside, a sheet is sent by a sheet storing part 101 to the conveyance unit 30. When the sheet is conveyed by the conveying belt 31 of the conveyance unit 30, ink is ejected from the inkjet heads 22, whereby the image is formed on the sheet. The sheet having the image formed thereon is conveyed by the rollers 8 of the delivery part 103 and delivered from the delivery port 9 to the delivery tray 10.

EJECTION RECOVERY MODE

First Embodiment

The operations performed in the ejection recovery mode by the recording apparatus 1 according to a first embodiment of the present invention are described next.

In the case where an image forming command is not issued or a power switch (not shown) is turned off for a predetermined time period after completion of an image forming operation, the recording apparatus 1 shifts from a condition where an image can be formed, to a standby condition. In other words, the conveyance unit 30 moves downward to a separated position that is away from an image forming position (the proximity position mentioned above), as the eccentric cams 41, 42 of the lifting mechanism 40 turn and enter the condition shown in FIG. 3 from the condition shown in FIG. 1. The maintenance unit 50 moves downward along with the conveyance unit 30 (as in the condition shown in FIG. 3), because the maintenance unit 50 is supported by the conveyance unit 30.

Figures 9A, 9B, 9C:
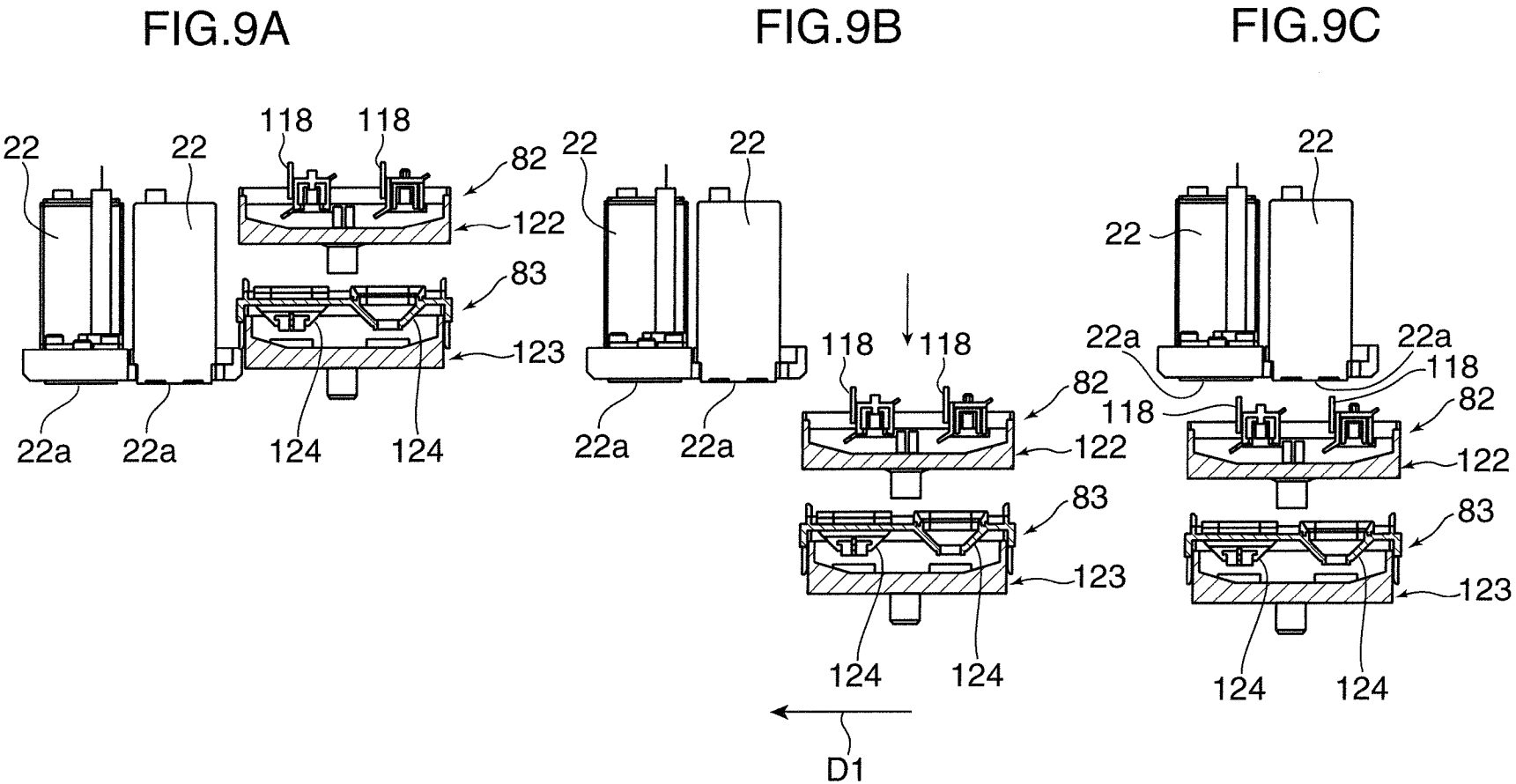
FIGS. 9A to 9C are schematic diagrams, each showing the operations of an early stage of an ejection recovery mode of the recording apparatus according to the first embodiment.

FIG. 9A, corresponding to the condition shown in FIG. 1, shows the positional relationship among the inkjet heads 22, the wiping unit 82, and the cap unit 83 in the image formation mode. FIG. 9B, corresponding to the condition shown in FIG. 3, shows the positional relationship among the inkjet heads 22, the wiping unit 82, and the cap unit 83, the positional relationship being obtained when the conveyance unit 30 moves to the separated position.

From the condition shown in FIG. 9B, the four wiping units 82 are moved in the direction D1 and the four cap units 83 are moved in the direction D1, by driving the motor M1 and motor M2 of the maintenance unit 50 to rotate the shafts S1 and S2 in one direction (in a clockwise direction in FIG. 6).

Figures 10A, 10B, 10C, 10D:
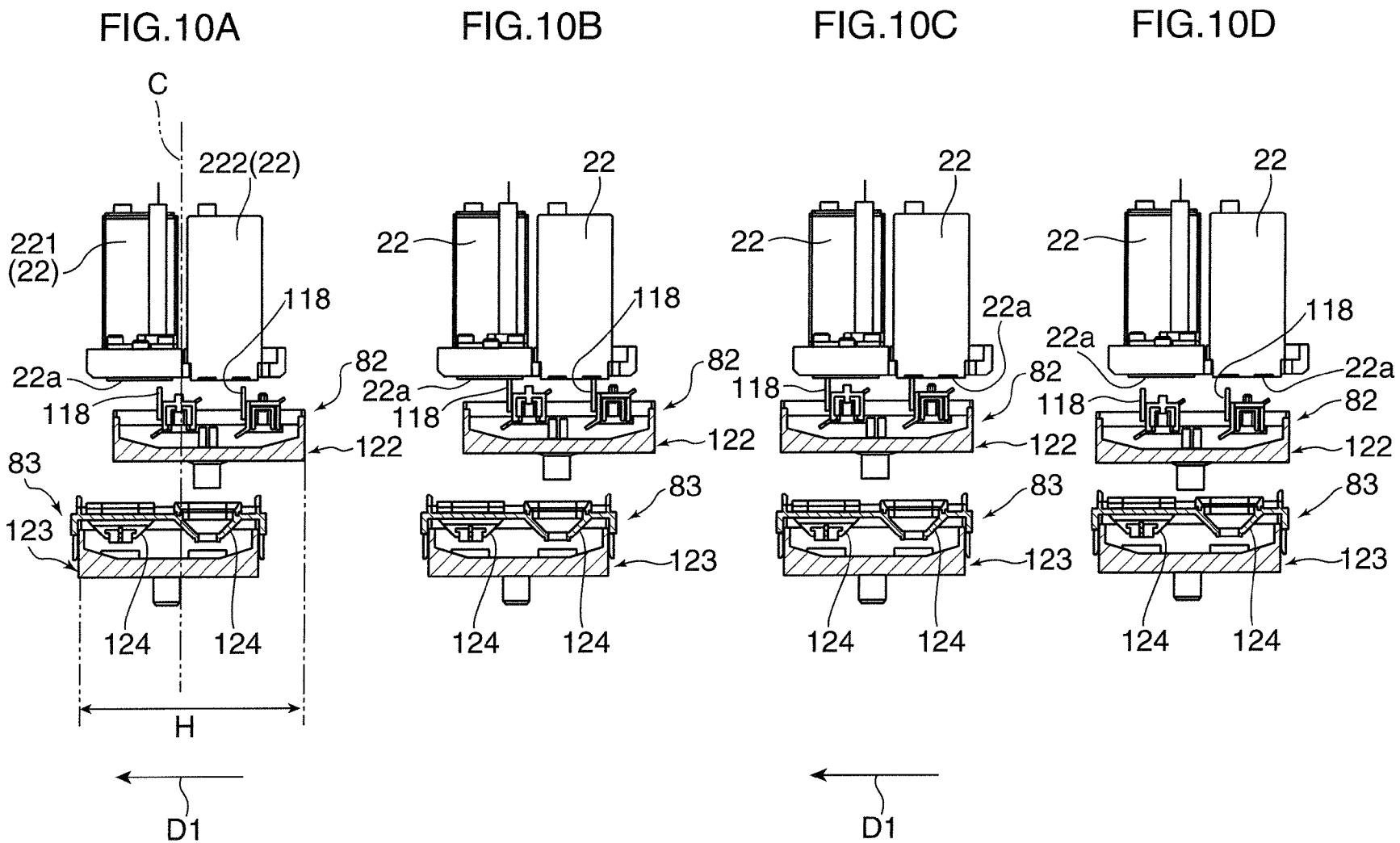
FIGS. 10A to 10D are schematic diagrams, each showing the operations of a middle stage of the ejection recovery mode.

The drive of the motor M1 is stopped, once the wiping unit 82 reaches a predetermined position below the inkjet heads 22 (an ink accepting position) (FIG. 9C), but the motor M2 continues driving. Then, the drive of the motor M2 is stopped, once the cap unit 83 reaches the predetermined position below the inkjet heads 22 (FIG. 10A). In the conditions shown in FIGS. 9C and 10A, the wiping members 118 are not in contact with the nozzle surfaces 22*a* and therefore disposed with a predetermined distance with the nozzle surfaces 22*a*.

As shown in FIG. 10A, the wiping unit 82 and the cap unit 83 are disposed in the positions mutually displaced in a surface direction of the nozzle surfaces 22*a* (the direction along the nozzle surfaces 22*a*). Specifically, the cap unit 83 is disposed in the position displaced from the position of the wiping unit 82 in the direction D1.

The cap unit 83 is displaced in the direction D1 with respect to a substantially central position C between an inkjet head 221 (22) in the direction D1 and an inkjet head 222 (22) on the opposite side of the direction D1. The wiping unit 82 is disposed on the opposite side of the direction D1. The cap unit 83 is disposed away from the wiping unit 82 in the direction D1. As a result, in the condition shown in FIG. 10A, an ink acceptable range H where the ink can be accepted by the wiping unit 82 and the cap unit 83 covers the range between an end side of the cap unit 83 in the direction D1 and an end side of the wiping unit 82 on the opposite side of the direction D1 (the range indicated by the two-dot chain lines in the diagram).

Figure 12:
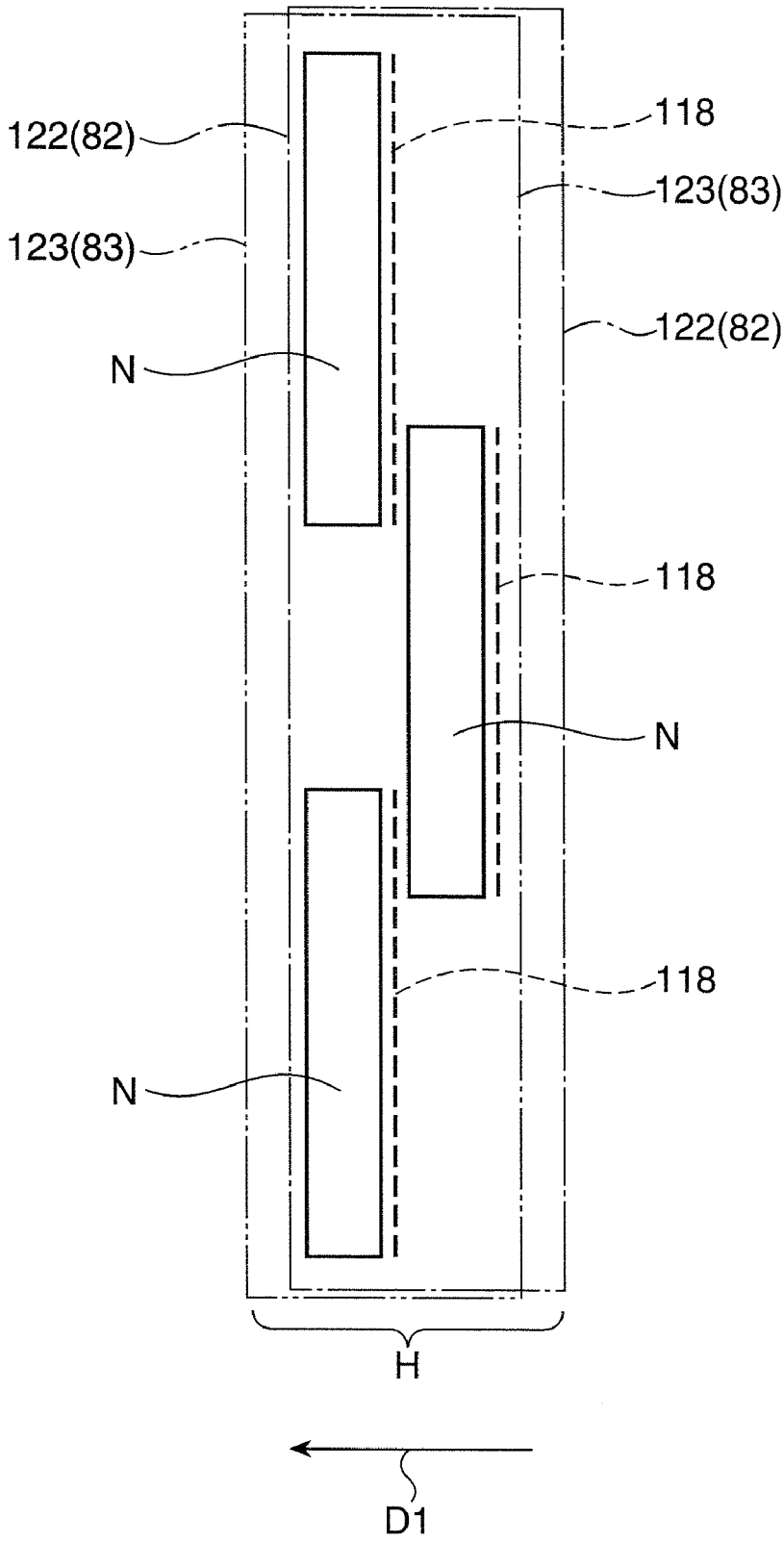
FIG. 12 is a plan view schematically showing the positional relationship among the wiping units, cap units and three of the inkjet heads in the condition shown in FIG. 10A.

In other words, the wiping tray 122 and the cap tray 123 cover the bottom of the nozzle forming regions N of the three inkjet heads 22, as shown in FIG. 12. Specifically, in a planar view of the nozzle forming regions N, wiping tray 122 and cap tray 123, each of the nozzle forming regions N is positioned within the wiping tray 122 and the cap tray 123. Therefore, the wiping tray 122 and the cap tray 123 can accept the ink ejected downward from the plurality of nozzles in the ejection recovery mode, without causing a leak.

In this condition, the ink is ejected from each inkjet head 22, and the ejected ink is stored in the wiping tray 122, or in both the wiping tray 122 and the cap tray 123.

Then, the eccentric cams 41, 42 are rotated in the direction in which leading ends of the eccentric cams 41 and 42 are lifted up, to slightly raise the conveyance unit 30 and the maintenance unit 50, thereby bringing the edges of the wiping members 118 into contact with the nozzle surfaces 22*a* (FIG. 10B). The position shown in FIG. 10B is a wiping start position.

Next, the nozzle surfaces 22*a* of the inkjet heads 22 are wiped by the wiping members 118, as shown in FIG. 10C. Each wiping member 118 moves in the horizontal direction (the direction D1) while wiping the corresponding nozzle surface 22*a* by bringing the edge of the wiping member 118 into contact with the nozzle surface 22*a*. As a result, the nozzle surface 22*a* is wiped by the wiping member 118.

More specifically, the four wiping units 82 are moved in the direction D1, by driving the motor M1 of the maintenance unit 50 to rotate the shaft S1 in one direction (in the clockwise direction in FIG. 6). The drive of the motor M1 is stopped, once the wiping members 118 of the wiping unit 82 reach the end parts of the nozzle surfaces 22*a* of the corresponding inkjet heads 22 (FIG. 10C). The position shown in FIG. 10C is a wiping end position.

Thereafter, the eccentric cams 41, 42 are rotated in a direction in which the leading ends of the eccentric cams 41 and 42 are lifted down, to slightly drop the conveyance unit 30 and the maintenance unit 50, thereby separating the edges of the wiping members 118 from the nozzle surfaces 22*a* (FIG. 10D).

The motor M1 and motor M2 of the maintenance unit 50 are then driven in order to rotate the shaft S1 and shaft S2 in the other direction (in the counterclockwise direction in FIG. 6), thereby moving the four wiping units 82 and the four cap units 83 in the direction opposite to the direction D1. The drive of the motor M1 and motor M2 is stopped, once each wiping unit 82 and each cap unit 83 reach predetermined positions (FIG. 11A).

Figure 11B:
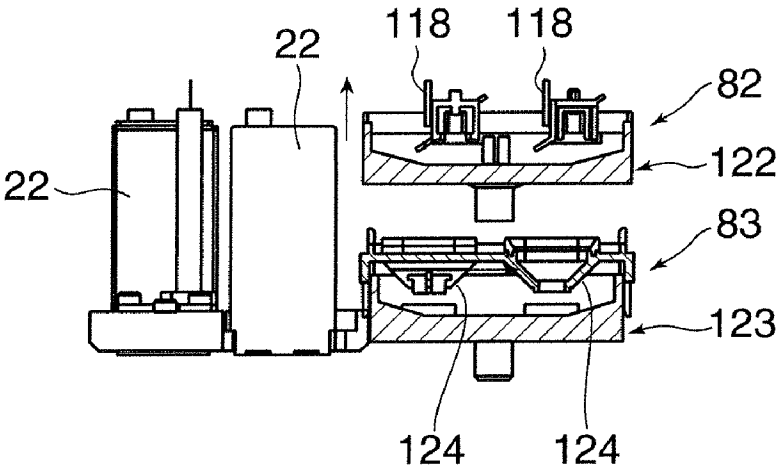
FIGS. 11A and 11B are schematic diagrams, each showing the operations of a final stage of the ejection recovery mode.
Figure 11A:
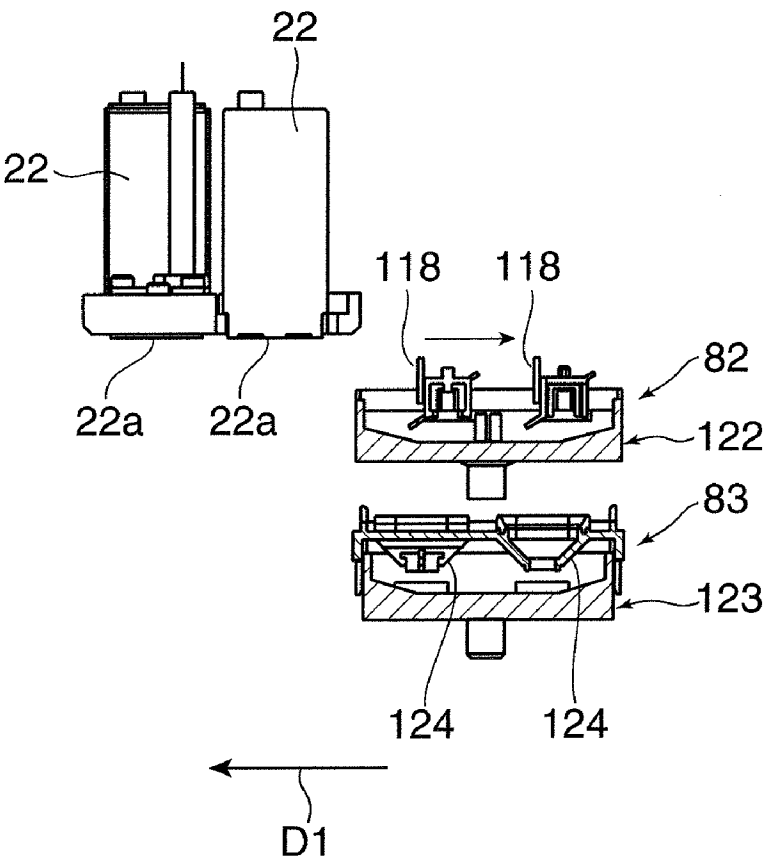

The series of operations may be ended in the position shown in FIG. 11A, or may be ended after moving the maintenance unit 50 to the position in the image formation mode as shown in FIG. 11B, if needed. In addition, after the ejection recovery mode described above is ended, the cap mode, which is described hereinafter, may be executed to cap the nozzle surfaces 22*a* of the inkjet heads 22.

A summary of the embodiment described above is set forth as follows.

(1) In the ejection recovery mode, the nozzle surfaces, the tray and the cap members are arranged, in this order, in the ejection direction in which the ink is ejected from the nozzles. Therefore, even when the ink falling from the nozzle surfaces cannot be accepted by the tray alone, the ink can be accepted by the cap members. Allowing the cap members to back the tray up in this manner can prevent contamination of the inside of the apparatus that is caused due to falling of ink adhered to nozzle surfaces in the ejection recovery processing. Moreover, in this configuration, because the cap members that cover the nozzle surfaces in the cap mode are used as the backup member for the tray, it is not necessary to provide another new backup member. This can limit the cost increases. Also, it is not necessary to ensure another separate space for disposing the new backup member.

(2) In a preferred aspect of the present invention, the recording apparatus has a cap tray, which supports the cap members and is larger than the cap members in terms of size in the direction along the nozzle surfaces. In this configuration, the range for backing up the tray can be increased in order to further enhance the effect of preventing contamination of the inside of the apparatus.

(3) In another preferred aspect of the present invention, each of the cap members configures a part or whole of the lid part that closes the upper part of the cap tray. In this configuration, the ink accepted by the cap tray can be prevented from becoming viscous, because the upper part of the cap tray is closed by the lid part.

Second Embodiment

Next, the operations performed in the ejection recovery mode by the recording apparatus 1 according to a second embodiment are described.

In the second embodiment, the wiping tray 122 is smaller than the cap tray 123 in terms of size in the direction along the nozzle surfaces 22*a* (the direction D1). The second embodiment is different from the first embodiment in this regard. Note that the same reference numerals are applied to the same components as those of the first embodiment, and the detailed descriptions thereof are omitted. In addition, because the operations shown in FIGS. 13A to 13D are same as the operations shown in FIGS. 10A to 10D explained in the first embodiment, the detailed descriptions thereof are omitted.

Figures 13A, 13B, 13C, 13D:
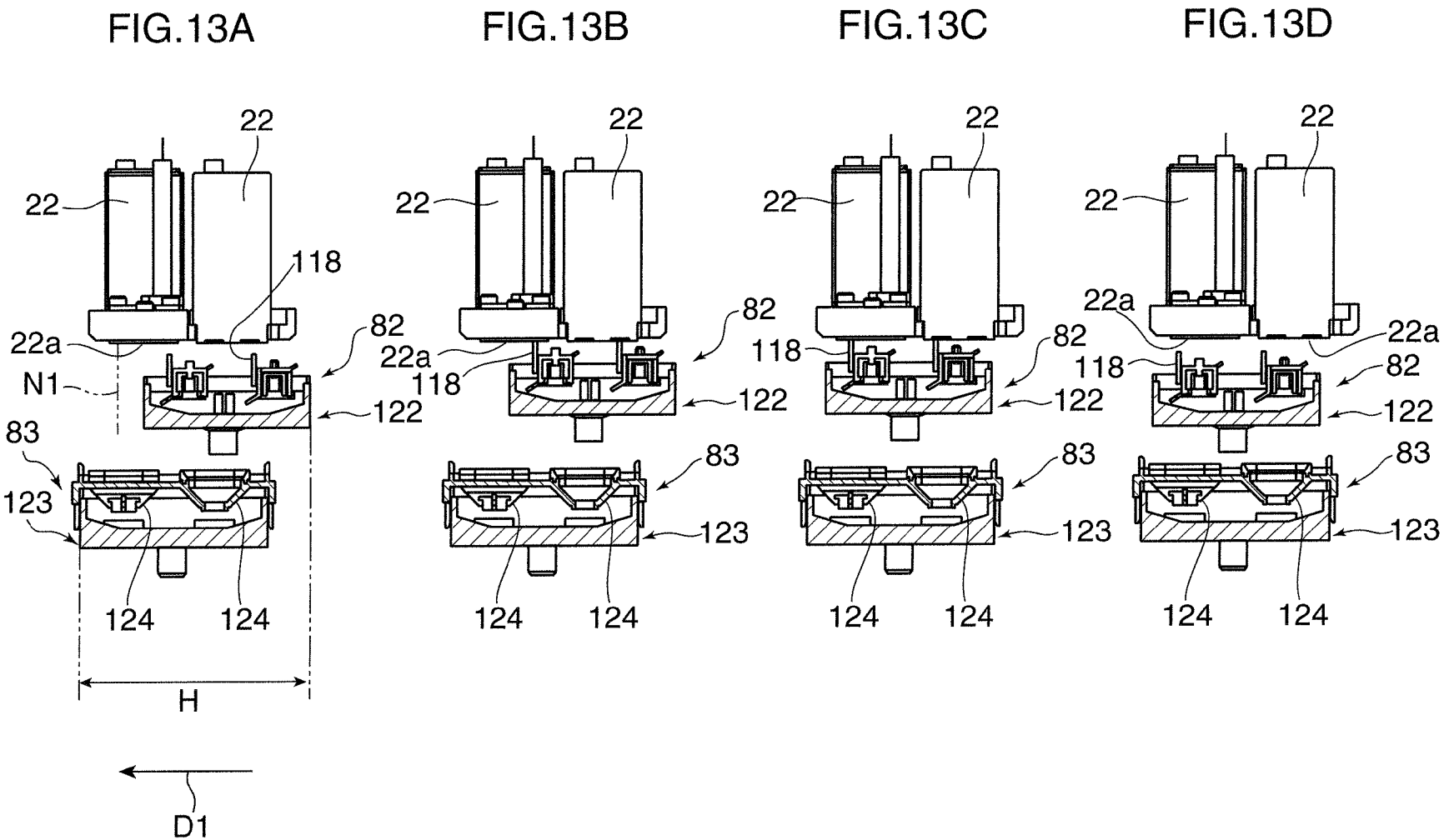
FIGS. 13A to 13D are schematic diagrams, each showing the operations performed in an ejection recovery mode by a recording apparatus according to a second embodiment.

As shown in FIG. 13A, because the size of the wiping tray 122 of the second embodiment is smaller than the wiping tray 122 of the first embodiment, the wiping tray 122 alone cannot cover the range up to an end part N1 of the nozzle forming region that is located in the direction D1, in the wiping start position. In the second embodiment, therefore, the cap tray 123 is disposed away from the wiping tray 122 in the direction D1 to back the wiping tray 122 up.

Therefore, a sufficient ink acceptable range H can be ensured, and the size of the wiping tray 122 can be reduced.

<Cap Mode>

The operations of the cap mode are described next.

Figure 14A:
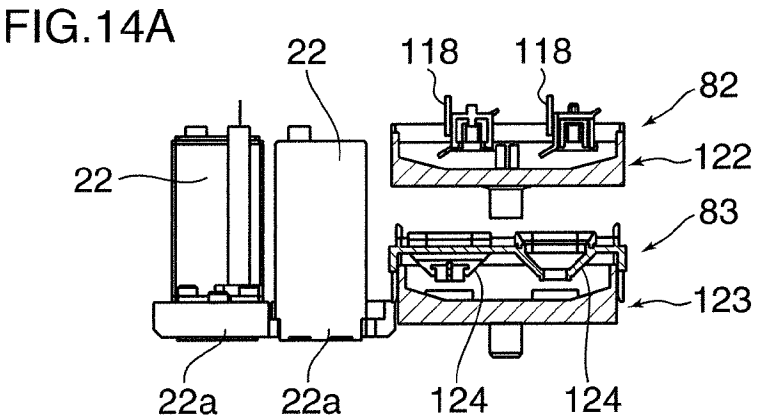
FIGS. 14A to 14D are schematic diagrams, each showing the operations of a cap mode.
Figure 14B:
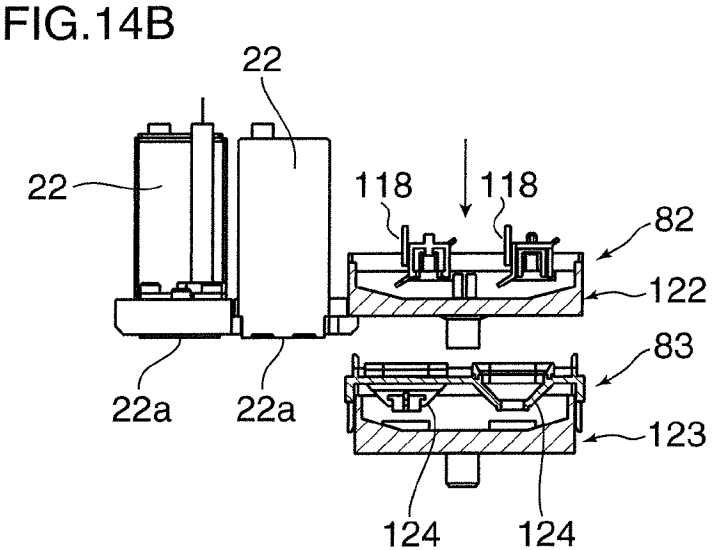

First, from the condition shown in FIG. 14A, the eccentric cams 41, 42 are rotated in the direction in which the leading ends of the eccentric cams 41 and 42 are lifted down, to drop the conveyance unit 30 and the maintenance unit 50. The position for stopping the operation of dropping the maintenance unit 50 is higher than the position obtained in the ejection recovery mode. In other words, as long as the cap unit 83 can move in the direction D1 so that the cap unit 83 is positioned below the inkjet heads 22, the rotation of the eccentric cams 41, 42 is stopped when the upper end of the cap unit 83 reaches below the nozzle surfaces 22*a* of the inkjet heads 22, as shown in FIG. 14B.

Next, the motor M2 of the maintenance unit 50 is driven to rotate the shaft S2 in one direction (in the clockwise direction in FIG. 6), to move the four cap units 83 in the direction D1.

Figure 14C:
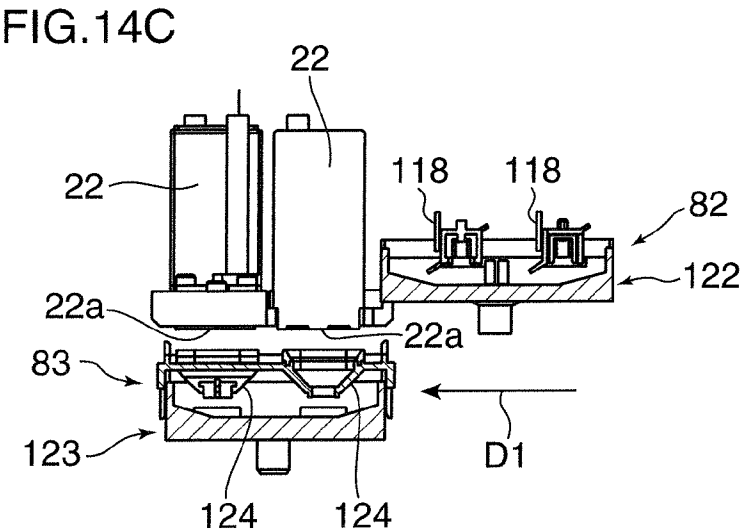

The drive of the motor M2 is stopped, once each of the cap units 83 reaches a predetermined position below the corresponding inkjet heads 22 (FIG. 14C). In the condition shown in FIG. 14C, each cap unit 83 is not in contact with the nozzle surfaces 22*a* and therefore disposed with a predetermined distance with the nozzle surfaces 22*a*.

Figure 14D:
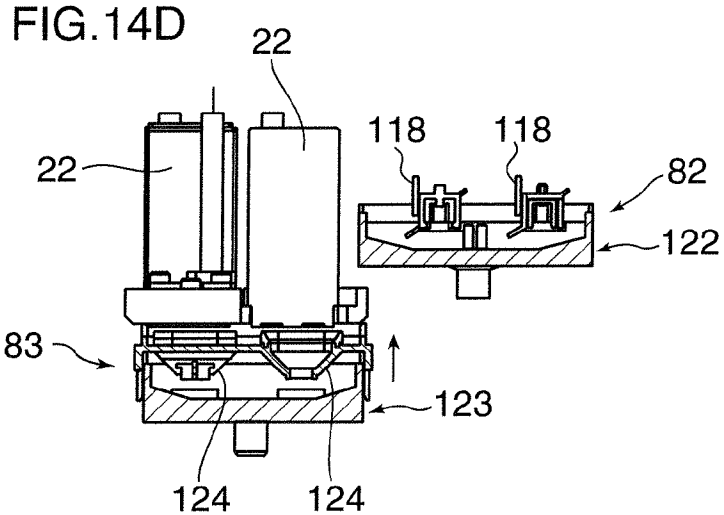

Subsequently, the eccentric cams 41, 42 are rotated in the direction in which the leading ends of the eccentric cams 41 and 42 are lifted up, to slightly raise the conveyance unit 30 and the maintenance unit 50, thereby bringing the elastic member 124*b* of each cap member 124 into contact with the corresponding nozzle surface 22*a* (FIG. 14D). As a result, the nozzle surface 22*a* of the corresponding inkjet head 22 is sealed by the cap member 124.

It should be noted that the present invention is not limited to the aforementioned embodiments, and can be changed variously or improved without departing from the scope thereof. For example, although each of the embodiments was described with an example of a four-color inkjet recording apparatus, the present invention can be applied to an inkjet recording apparatus that uses single color ink or ink of at least five colors.

Furthermore, although each of the embodiments was described with an example where each cap unit had caps and a cap tray, the cap tray may be omitted and only the caps may back up the wiping tray.

Although each of the embodiments was described with an example where the wiping members of each wiping unit are in an elongated flat shape, the wiping members may be in a different shape.

Each of the embodiments was described with an example where the recording apparatus had the first movement mechanism and second movement mechanism, which move each wiping unit and each cap unit relatively with respect to the inkjet heads. However, the inkjet heads may be moved relatively with respect to the wiping unit and the cap unit, as long as the first movement mechanism and the second movement mechanism can move the wiping unit and the cap unit relatively with respect to the inkjet heads.

In addition, each of the embodiments has illustrated the case where the lid part is configured by the cap members, the panel part, and the extending part, but the lid part may be configured by, for example, the cap members only.

This application is based on Japanese Patent application serial No. 2009-267333 filed in Japan Patent Office on Nov. 25, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An inkjet recording apparatus, comprising:

an inkjet head that has a nozzle surface including a nozzle forming region provided with a plurality of nozzles;

a tray that is capable of being disposed opposite to the nozzle surface and storing ink ejected from the plurality of nozzles;

a wiping member that is supported by the tray and capable of coming into contact with the nozzle surface;

a first movement mechanism that moves the tray relatively with respect to the inkjet head in a direction substantially parallel to the nozzle surface;

a cap member that is capable of being disposed opposite to the nozzle surface to cover the nozzle surface;

a second movement mechanism that moves the cap member relatively with respect to the inkjet head in the direction substantially parallel to the nozzle surface; and a controller that controls the first movement mechanism and the second movement mechanism, wherein, in a cap mode where the cap member covers the nozzle surface, the controller controls the second movement mechanism so that the cap member is disposed opposite to the nozzle surface, and in an ejection recovery mode where the ink is ejected from the plurality of nozzles and the ink adhered to the nozzle surface is wiped off by the wiping member, the controller controls the first movement mechanism and the second movement mechanism so that the nozzle surface, the tray and the cap member are arranged, in this order, in an ejection direction in which the ink is ejected from the nozzles.

2. The inkjet recording apparatus according to claim 1, further comprising a cap tray, which supports the cap member and is larger than the cap member in terms of size in a direction along the nozzle surface, wherein, in the ejection recovery mode, the nozzle surface, the tray and the cap tray are arranged, in this order, in the ejection direction.

3. The inkjet recording apparatus according to claim 2, wherein the tray supporting the wiping member is smaller than the cap tray in terms of size in sheet conveying direction in which a sheet is conveyed.

4. The inkjet recording apparatus according to claim 2, wherein the cap member configures a part or whole of a lid part that closes an upper part of the cap tray.

5. The inkjet recording apparatus according to claim 2, wherein, when the tray is in a wiping start position in the ejection recovery mode, the cap tray is disposed in a position displaced from the wiping start position of the tray in a wiping direction in which the wiping member moves relatively with respect to the inkjet head.

6. The inkjet recording apparatus according to claim 5, wherein when the tray is in the wiping start position, one end of the tray in the wiping direction is located between one end of the cap tray in the wiping direction and the other end of the cap tray, the other end of the tray is located on a side opposite to the wiping direction with respect to the other end of the cap tray.

7. The inkjet recording apparatus according to claim 6, wherein when the tray is in a wiping end position in the ejection recovery mode, the one end of the tray and the one end of the cap tray are located at a same position in the wiping direction.

8. The inkjet recording apparatus according to claim 3, wherein, when the tray is in a wiping start position in the ejection recovery mode, the cap tray is disposed in a position spaced from the wiping start position of the tray in a wiping direction in which the wiping member moves relatively with respect to the inkjet head.

9. The inkjet recording apparatus according to claim 8, wherein when the tray is in the wiping start position, one end of the tray in the wiping direction is located between one end of the cap tray in the wiping direction and the other end of the cap tray, the other end of the tray is located on a side opposite to the wiping direction with respect to the other end of the cap tray.

10. The inkjet recording apparatus according to claim 9, wherein, when the tray is in a wiping end position in the ejection recovery mode, the one end and the other end of the tray are located between the one end and the other end of the cap tray.

11. The inkjet recording apparatus according to claim 2, wherein the cap tray has a bottom plate that is capable of being disposed opposite to the inkjet head in the ejection direction and side walls that extend up from a circumferential rim of the bottom plate, the cap tray having an opening part at an upper part of the cap tray.

12. The inkjet recording apparatus according to claim 1, wherein the tray has a bottom plate that is capable of being disposed opposite to the inkjet head in the ejection direction and side walls that extend up from a circumferential rim of the bottom plate.

13. The inkjet recording apparatus according to claim 2, wherein, in an image formation mode where the inkjet head forms an image on a sheet, the tray and the cap tray are disposed in a retreat position lateral to the inkjet head.

14. The inkjet recording apparatus according to claim 13, wherein, in the cap mode, the cap tray is disposed below the inkjet head and the tray is disposed in a position lateral to the inkjet head.

15. The inkjet recording apparatus according to claim 1, wherein a plurality of the inkjet heads are arranged in a sheet conveying direction in which a sheet is conveyed, the nozzle surface of each of the inkjet heads includes a first nozzle surface and a second nozzle surface, each of the inkjet heads includes a first inkjet head portion having the first nozzle surface and second inkjet head portion having the second nozzle surface, a plurality of the trays respectively correspond to the inkjet heads, each of the trays has a single bottom plate that is capable of being disposed opposite to the first and second inkjet head portions of the corresponding inkjet head in the ejection direction and side walls that extend up from a circumferential rim of the single bottom plate, and a plurality of the wiping members include a first wiping member that is capable of coming into contact with the first nozzle surface in the first inkjet head portion and a second wiping member that is capable of coming into contact with the second nozzle surface in the second inkjet head portion, a plurality of the cap members include a first cap member that is capable of being disposed opposite to the first nozzle surface in the first inkjet head portion to cover the first nozzle surface and a second cap member that is capable of being disposed opposite to the second nozzle surface in the second inkjet head portion to cover the second nozzle surface.

16. The inkjet recording apparatus according to claim 15, further comprising a plurality of cap trays respectively corresponding to the inkjet heads, each of the cap trays supporting the first and second cap members and being larger than the first and second cap members in terms of size in a direction along the nozzle surface, each of the cap trays having a single bottom plate that is capable of being disposed opposite to the first and second inkjet head portions in the corresponding inkjet head in the ejection direction and side walls that extend up from a circumferential rim of the single bottom plate, and in the ejection recovery mode, each set of the nozzle surface of the inkjet head, the tray and the cap tray is arranged in the order of the nozzle surface, the tray and the cap tray in the ejection direction.

* * * * *